US009415837B2

(12) United States Patent
Wendels

(10) Patent No.: US 9,415,837 B2
(45) Date of Patent: Aug. 16, 2016

(54) DEVICE FOR CONTROLLING AT LEAST ONE OF TRIM AND STEERING OF A BOAT, SHIP OR VESSEL

(71) Applicant: Prezip Technology AB, Västra Frölunda (SE)

(72) Inventor: Nils Wendels, Åsa (SE)

(73) Assignee: PREZIP TECHNOLOGY AB, Västra Frölunda (SE)

( * ) Notice: Subject to any disclaimer, the term of this patent is extended or adjusted under 35 U.S.C. 154(b) by 178 days.

(21) Appl. No.: 14/357,544

(22) PCT Filed: Nov. 9, 2012

(86) PCT No.: PCT/EP2012/072215

§ 371 (c)(1),
(2) Date: May 9, 2014

(87) PCT Pub. No.: WO2013/068515

PCT Pub. Date: May 16, 2013

(65) Prior Publication Data

US 2014/0318432 A1 Oct. 30, 2014

(30) Foreign Application Priority Data

Nov. 10, 2011 (SE) ..... 1151064

(51) Int. Cl.
*B63B 1/32* (2006.01)
*B63H 25/44* (2006.01)
*B63B 39/06* (2006.01)

(52) U.S. Cl.
CPC ..... *B63B 1/32* (2013.01); *B63B 39/061* (2013.01); *B63H 25/44* (2013.01)

(58) Field of Classification Search
CPC ..... B63B 39/061; B63B 25/44
See application file for complete search history.

(56) References Cited

U.S. PATENT DOCUMENTS 1,879,547 A * 9/1932 Semmes ..... B64C 35/00 114/145 R
2,006,515 A * 7/1935 Semmes ..... B64C 35/00 114/145 R (Continued)

FOREIGN PATENT DOCUMENTS

EP 1092624 A2 4/2001
EP 1075415 B1 12/2003

OTHER PUBLICATIONS

International Preliminary Report on Patentability received for PCT Patent Application No. PCT/EP2012/072215, mailed on May 22, 2014, 6 pages.

(Continued)

*Primary Examiner* — Edwin Swinehart
(74) *Attorney, Agent, or Firm* — Morrison & Foerster LLP

(57) ABSTRACT

The invention describes a device for controlling trim and/or steering of a boat, ship or vessel having an actuator, an actuating means and an interceptor member, wherein the actuator acts upon the actuating means, which acts upon said interceptor member such that the interceptor member is linearly displaceable between a retracted and an extracted position. Further, the actuating means is displaceable in a first direction and acts upon a first and a second crankshaft, wherein the first and second crankshafts are arranged such that they rotate in opposite direction relative to each other when the actuating means acts thereon. Thereafter the first and second crankshafts interact with the interceptor member such that a rotation of the first and second crankshafts consequently lead to a displacement of the interceptor member between the refracted and the extracted position, wherein the displacement of the interceptor member is perpendicular to the first direction.

14 Claims, 6 Drawing Sheets

(56) References Cited

U.S. PATENT DOCUMENTS

| | | | | |
|---|---|---|---|---|
| 3,498,248 | A * | 3/1970 | Van Bibber | B63B 1/38 114/274 |
| 8,622,012 | B2 * | 1/2014 | Olofsson | B63B 39/061 114/122 |

OTHER PUBLICATIONS

International Search Report and Written Opinion received for PCT Patent Application No. PCT/EP2012/072215, mailed on May 6, 2013, 7 pages.

* cited by examiner

DEVICE FOR CONTROLLING AT LEAST ONE OF TRIM AND STEERING OF A BOAT, SHIP OR VESSEL

CROSS REFERENCE TO RELATED APPLICATIONS

This application is a U.S. National Phase patent application of PCT/EP2012/072215, filed on Nov. 9, 2012, which claims priority to Swedish Patent Application No. 1151064-1, filed on Nov. 10, 2011, each of which is hereby incorporated by reference in the present disclosure in its entirety.

TECHNICAL FIELD

The invention pertains to a device for dynamically controlling a running trim and/or steering of a boat having at least one hull with a stern. The device comprises a housing, transmission means and an interceptor member. The interceptor member is linearly displaceable in relation to the housing. Further, the housing is adapted to be attached to the hull of the boat. The present invention is applicable for dynamically controlling the running trim and/or steering of boats, ships or any large vessel or watercraft. The invention is especially applicable for planing or semi-planing boats.

BACKGROUND ART

A number of devices that are used for dynamically controlling the running trim and steering of a boat are known in the art. Most common are trim tabs or trim flaps. Interceptors become however more and more common. These interceptor devices generally have an interceptor member, an actuator and a power supply means. The interceptor can be arranged directly on the boat hull or in a housing. Commonly the actuator acts upon the interceptor member to linearly displace it in water for dynamically controlling the running trim and steering of the boat. Further, to attain the desired trim and steering control/effect the interceptor member is accordingly displaced to a suitable level in water.

In order to provide sufficient power to suitably displace the interceptor member in water, multiple actuators or a single large actuator is used. One known arrangement is disclosed in EP 1 075 415, and having a single large actuator, which is provided to displace the interceptor member. The said interceptor member is constructed as a "T" shaped body and therefore has both vertical and horizontal sections with respect to the actuator. The vertical section of the interceptor member is the one connected to the actuator and acts as guiding means for the interceptor member. The usage of such guiding means is needed to achieve the sufficient stability to assure a linear movement of the interceptor member during operation. Further, the guiding means itself is subject to frictional forces during operation. In order to overcome these frictional forces, stronger actuators and/or possibly also bearings along the sides of the guide is required. The usage of a strong actuator makes the device more expensive, heavy and large. Further, the usage of extra bearings increases the manufacturing cost and the maintenance cost of the device.

Further, in case of devices having multiple actuators or multiple components/parts, the task of assembling these devices is cumbersome. Multiple actuators are placed outside the device body due to space and size constraints. A mounting of a plurality of actuators together with interceptor members demands an abundance of attachment means and thereby mostly undesired damage to the transom of the hull of the boat. It is desired to keep the hull as undamaged under the waterline as possible.

Furthermore, a boat owner considering replacing an existing device of such kind with a newer version may find it very difficult to do so. This is so because the preformed grooves etc. required for one device may not be compliant with the newer device. This scenario will also arise in case the existing device is totally damaged/non-functional and needs replacement.

In light of the above discussion, there is a need for a new and improved interceptor assembly which will overcome the problems associated with the existing products and provide a compact, reliable device that is easy to assemble on the hull of the boat.

SUMMARY

Among others the object of the present invention is to provide an inventive device for dynamically controlling a trim and/or steering of a boat, ship or vessel. It is desired that the inventive device is a compact, reliable device that is easy to assemble and mount on the outside of the hull of the boat.

The invention relays upon the idea to use a transmission mechanism between the actuator and interceptor member. Said transmission mechanism is constructed such that it cancel out the side forces upon the interceptor member, such that it thereby can move between its retracted and extracted position, without any guiding means and without getting skew.

The device according to the invention comprises an actuator, an actuating means, and an interceptor member.

Said actuator interacts with said actuating means, which interacts with said interceptor member such that said interceptor member is continuous and linearly displaceable between a retracted and an extracted position.

The inventive device is characterised in, that said actuating means is continuously displaceable and is adapted to interact with a first and a second crankshaft, whereby a displacement of said actuating means causes a rotation of said first and second crankshaft, wherein said first and second crankshaft are arranged such relative each other that they rotate in opposite direction when said actuating means acts thereon, and whereby said crankshafts are adapted to interact with said interceptor member, such that a rotation of the crankshafts consequently leads to a displacement of said interceptor member. The crankshafts are further arranged such that they interact upon the interceptor member on essentially the same height, i.e. distance from the interceptor members lower edge, wherein the lower edge is the edge acting in the water.

Essentially the same height is defined such that the lowest point of an interaction surface between the highest placed crankshaft and the interceptor member never is above the highest point of the lowest positioned placed crankshaft.

The crankshafts are preferably arranged such that they interact upon the interceptor member on essentially the same distance to a centreline of the length of the interceptor member.

Essentially the same distance to the centre line has the same tolerances as the height position of the interceptor member.

The interceptor member is continuously and linearly displaced and said displacement is perpendicular to the length direction of the interceptor member.

The rotation of the crankshaft in the opposite direction gives the advantage that the side forces acting on the interceptor member are essentially equally large and thus cancel each other out. Thus there is no need for a guiding means as it is known in the prior art, to keep the interceptor member from wedging due to skewness of force distribution in the guiding means. Since no guiding means is needed the frictional force acting on the interceptor member decreases. Further, as the side forces subjected on the interceptor member by the crankshafts are directed in opposite direction and thereby cancel each other out and the crankshafts provide the side support. The interceptor member is stabilised and no additional side support is needed. Further advantages are that the frictional forces decrease whereby a smaller actuator can be used. The usage of a smaller actuator decreases the power consumption of the device and also lowers the cost for production of the device and obviously makes the device compact, wherein it fits on the space left on the transom stern of the boat.

Said crankshafts are adapted to interact with said interceptor member, such that the side forces caused by the rotation of the crankshafts are parallel to the length direction of the interceptor member and thereby cancel each other out. This will stabilise the interceptor member, wherein the use of a guiding means becomes excessive. It is thereby advantageous that said first and said second crankshaft are arranged on a distance to each other in the length direction of the interceptor member. It is preferred that the first and second crankshaft interacts upon said interceptor member on the same height of the interceptor member, this is however not always beneficial in order become a high density construction of the device and also not always necessary in order to achieve the desired effect. As long as the height of the interaction area between the cranks and the interceptor member overlap each other, a sufficient force cancellation of the side forces will take place.

Suitable crankshafts are provided with a central shaft with a first and a second crank in each end of said central shaft, wherein said first cranks interact with said actuating means and said second cranks interact with said interceptor member, wherein said first and second cranks are displaced relative each other.

The first and the second crank are advantageously displaced with about a quarter of a revolution relative each other. Such a configuration of the first and second cranks on the central shaft enables that the displacement of the actuating means is perpendicular to the displacement of the interceptor member. Other relation between the first and the second crank is possible, whereby the displacement of the actuating means thereby will be in a different angle to the displacement of the interceptor member. Having a displacement of the actuating means, parallel to the length direction of the device, is convenient, because the actuator can thereby also be placed lengthwise in the device and the mechanism to transmit the rotating movement of the actuator to the linear movement of the actuating means with a screw connection. This also enables a lengthwise arrangement of the actuator, enabling it to fit within a housing of the device.

Further, the crankshafts are arranged in the said device such, that the respective second cranks move in the direction of the displacement of the interceptor member essentially synchronously with the other. This synchronised movement of the crankshafts does not cause any skew movement while the crankshafts are moving and thus prevents the interceptor member from getting stuck or jammed.

Furthermore, the first cranks are provided with corresponding first sliding shoes. Said first sliding shoes are adapted to slide in corresponding grooves in said actuating means. The arrangement of the sliding shoes in the corresponding grooves decreases the friction between the crankshaft and the actuating means as there is no rotary motion between them.

Furthermore, the second cranks are provided with corresponding second sliding shoes. Said second sliding shoes are adapted to slide in corresponding grooves in said interceptor member. The arrangement of the sliding shoes in the corresponding grooves decreases the friction between the crankshaft and the interceptor member as there is no rotary motion between them.

By using sliding shoes adapted to slide in grooves in respective interaction party (actuating means and interceptor member) side forces causing the interceptor member to rotate are effectively cancelled out. It is essential that the respective sliding shoes acting upon the interceptor member acts at least partially at the same height on the interceptor member. That is the lowest point of the height positioned sliding shoe never is above the highest point of the lowest positioned sliding shoe.

In an advantageous embodiment of the inventive device, the actuating means is displaceable in a direction perpendicular to the direction of the displacement of said interceptor member. Such an arrangement facilitates an optimal force distribution.

It is further advantageous if the inventive device is provided with housing, in which said actuator, actuating means and said interceptor member is arranged, whereby the interceptor member is positioned at least partial outside said housing in its extracted position and positioned inside said housing in its retracted position.

In an embodiment of the invention, said housing comprises a back plate and a front plate and wherein the actuating means, the crankshafts and the interceptor member are arranged in-between said back and said front plate. The provision of the back plate and the front plate forming the housing and encloses the device and also protects the device. Further, the device can be mounted on to the boat hull through the back plate.

It is further advantageous if said back plate of the inventive device is provided with a lip/seal which extends perpendicular to the displacement of said interceptor member and said lip/seal is adapted to seal between said back plate and said interceptor member. The lip/seal protects the device from the high pressure that occurs on the back of the device. The lip/seal also acts as a scraper and scrapes off any dirt or marine growth, e.g. barnacles that are attached to the interceptor member. Thus, the lip/seal increases the lifecycle of the whole device by protecting it from unnecessary wear caused by high pressure and contaminations.

Further, the actuator is preferably mounted in between said back and said front plate in the device. The actuator is preferably submersible. Due to the inventive device, which enables the use of a smaller actuator then for previously known devices, the actuator can be provided within the housing (in between the front and the back plate) of the device, without the housing becoming unjustifiably large.

Rollers can be arranged in-between the interceptor member and the front and the back plate, in order to decrease the friction there between.

A holding member is advantageously mounted on the interceptor member, wherein said second cranks are adapted to act upon said holding member such that said holding member is displaced half the distance of the displacement of the said interceptor member. The holding member is preferably arranged between the interceptor member and said front plate. Further, the holding member could be provided with multiple slots to house a plurality of rollers acting as bearings between the interceptor member and the front plate, wherein the bearings reduce the frictional forces between the interceptor member and the housing. Thus the frictional forces acting on the device are reduced and a smoother movement of the interceptor member is achieved.

In yet another advantageous embodiment of the inventive device, the actuator of the said device is an electric actuator.

An electric actuator can be fitted within the housing of the device, wherein no additional grooves/slots/holes are required on the boat hull. The device is possible to use with other art of actuators such as hydraulic or pneumatic actuators, an electric actuator is however preferred.

The device of the present invention is applicable for dynamically controlling the running trim and/or steering of boats, ships or any large vessel or watercraft.

BRIEF DESCRIPTION OF THE DRAWINGS

In the following section, the invention will be described in a greater detail with reference to embodiments shown by the enclosed figures. It should be emphasised that the embodiments shown are used for example purposes only and should not be used to limit the scope of the invention.

A person skilled in the art will readily appreciate that various features disclosed in the description may be modified, and that various embodiments disclosed and/or claimed may be combined without departing from the scope of the invention.

DETAILED DESCRIPTION

Figure 1A:
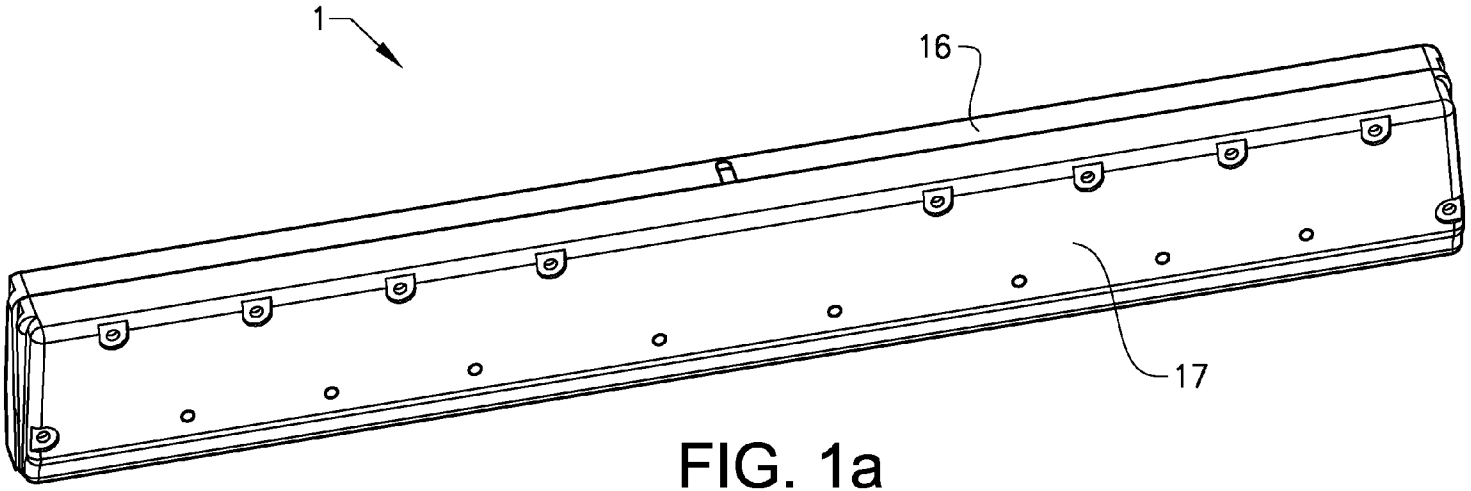
FIG. 1 illustrates an exploded and perspective view of a device for the dynamic control of the running trim and/or steering of a boat.
Figure 1B:
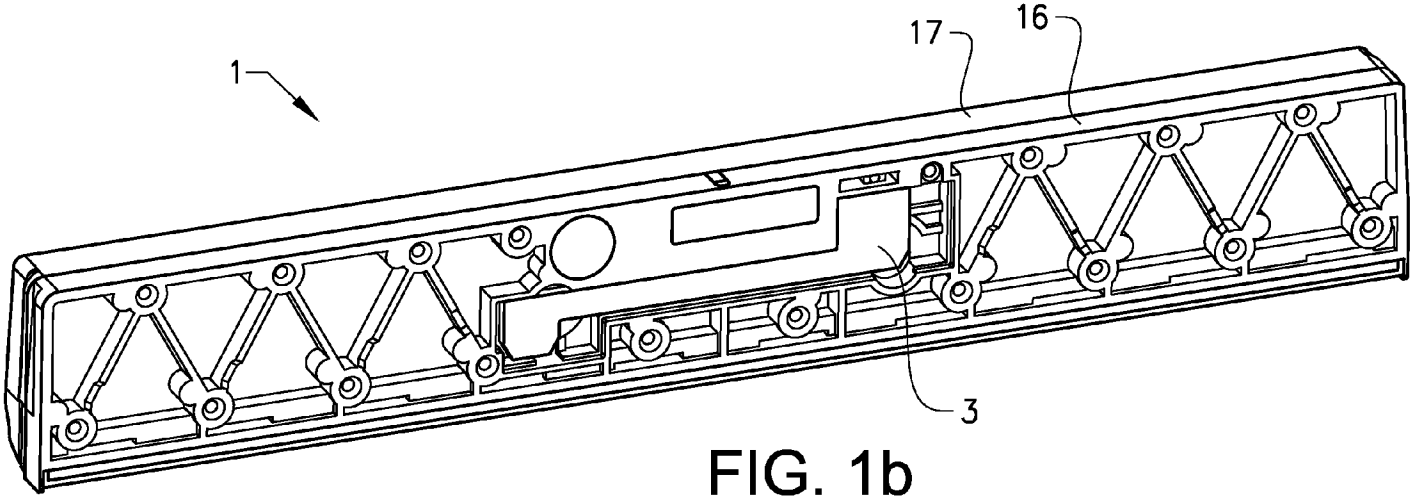
Figure 1C:
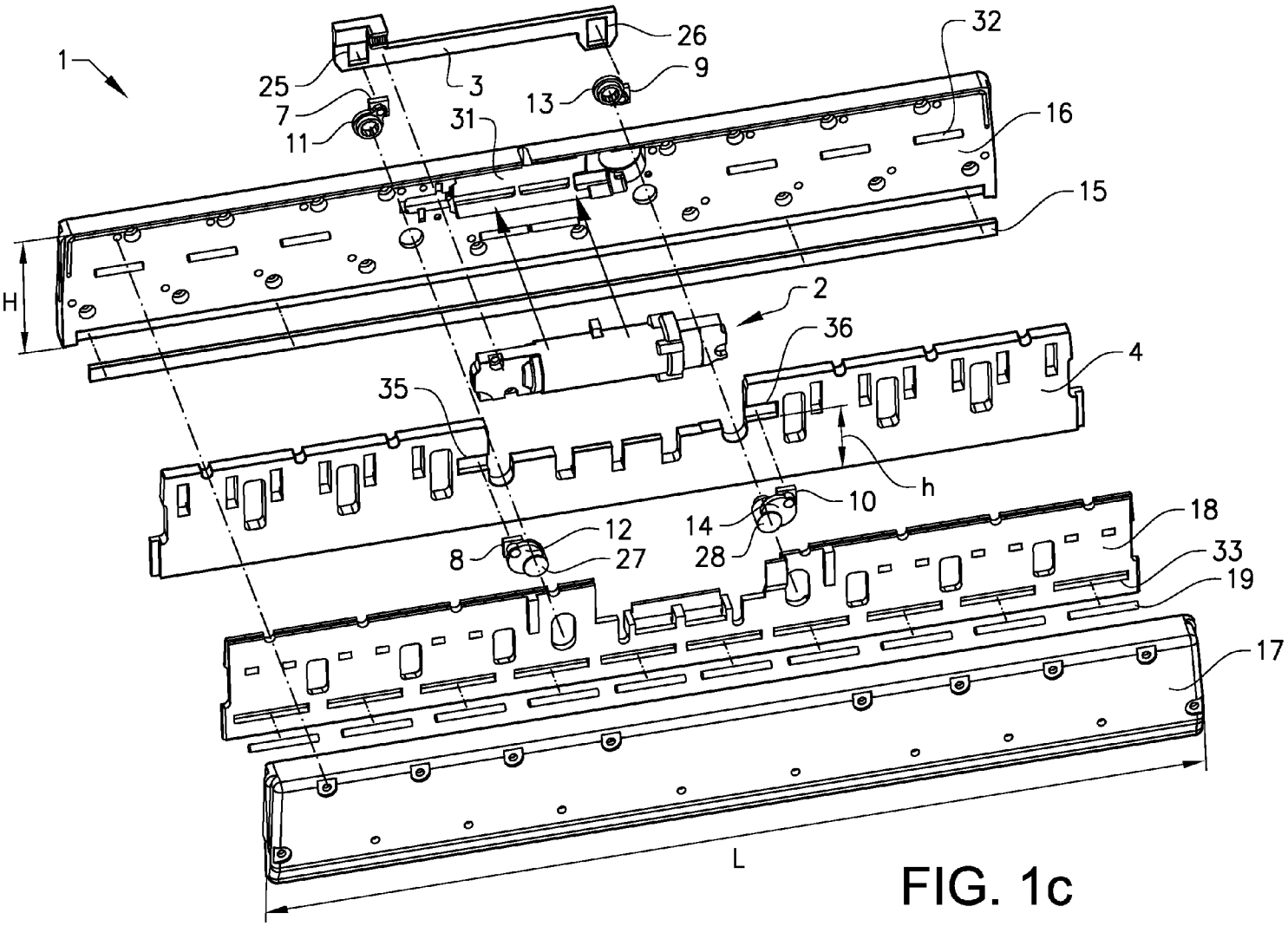

FIG. 1*a* illustrates a first view of an assembled device 1 according to the invention and FIG. 1*b* illustrates a second view of the assembled device 1, and FIG. 1*c* illustrates an exploded and perspective view of the device 1 used for dynamically controlling the running trim and/or steering of a boat, in accordance with an embodiment of the invention. The device 1 comprises an actuator 2, an actuating means 3, and an interceptor member 4. As will be evident to a person ordinarily skilled in the art, the actuator 2 can be of any type known in the art. Some examples of such an actuator are an electric, pneumatic or hydraulic or a combustion driven actuator. However an electric actuator is preferred and also shown. The actuator 2 is adapted to be arranged in a preformed slot 31 provided in the back plate 16.

The device 1 further comprises a first crankshaft 5 and a second crankshaft 6. The first crankshaft 5 includes a centre shaft 27, a first crank 11 and a second crank 12. The first crank 11 is provided at a first end of the centre shaft 27 and the second crank 12 is provided at the second end of the centre shaft 27. The first crankshaft 5 is provided with a first sliding shoe 7 that is attached to the first crank 11 and a second sliding shoe 8 that is attached to the second crank 12.

Similarly, the second crankshaft 6 includes a centre shaft 28, a first crank 13 and a second crank 14. The first crank 13 is provided at a first end of the centre shaft 28 and the second crank 14 is attached at the second end of the centre shaft 28. Further, the second crankshaft 6 is provided with a first sliding shoe 9 that is attached to the first crank 13 and a second sliding shoe 10 that is attached to the second crank 14.

The first and the second crankshaft 5, 6 are operably coupled to the actuating means 3 and which together forms a transmission means 30 (shown in FIGS. 2 and 3) at which actuator 2 acts. Further, the transmission means 30 is operably connected to the interceptor member 4 over the sliding shoes 8, 10 provided on respective second cranks 12, 14 to act thereon.

The device 1 also comprises a back plate 16, at which the components of the transmission means 30 is provided. A holding member 18 and a front plate 17 are also provided, wherein said front plate 17 forms a housing of the device 1 together with the back plate 16. In the shown embodiment of the invention, a lip 15 is provided at the bottom edge of the back plate 16. The lip 15 extends perpendicularly to the displacement of the interceptor member 4. The lip 15 is adapted to seal between the back plate 16 and the interceptor member 4, to protect the device 1 from high pressure water and to act as a scraper to remove dirt and/or marine growth. As will be evident to a person ordinarily skilled in the art, the lip 15 can be made up of any suitable material. The back plate 16 is also provided with a number of pre-drilled holes to conveniently attach the housing of the device 1 to the hull of the boat.

The device 1 has a length L which is essentially the length of the interceptor member 4. This is enabled since no guiding means is needed to provide the linear displacement. Further the height H of the device is compact, because the actuator is provided inside the device 1 and no extending guiding means, as in some prior art, is needed, due to the inventive transmission means 30.

The first and the second crank 11, 12 interacts with the interceptor member on essentially the same height h and symmetrically arranged about the interceptor members centreline c, i.e. each arranged half the distance d from the centreline c. Forces occurring from the crank 11, 12 in the length direction of the device cancel thereby each other out, wherein a linear displacement is enabled without any guiding means and with just one actuator 2. Because the forces, in the length direction of the device, from the first and the second crankshaft 11, 12 are directed in opposite direction relative each other and are essentially equally large, these will cancel each other out.

Rollers 16, 32 are provided between the interceptor member 4 and the front plate 17 respectively the interceptor member 4 and the back plate 16. The rollers decreases the friction between the parts they are placed. The rollers between the interceptor member 4 and the front plate 17 are arranged in slots 33 in the holding member 18. Wherein the holding member 18 is displaced half the distance of the interceptor member 4 during a retraction and extraction, wherein a "perfect roller rolling motion" is achieved.

Figure 2A:
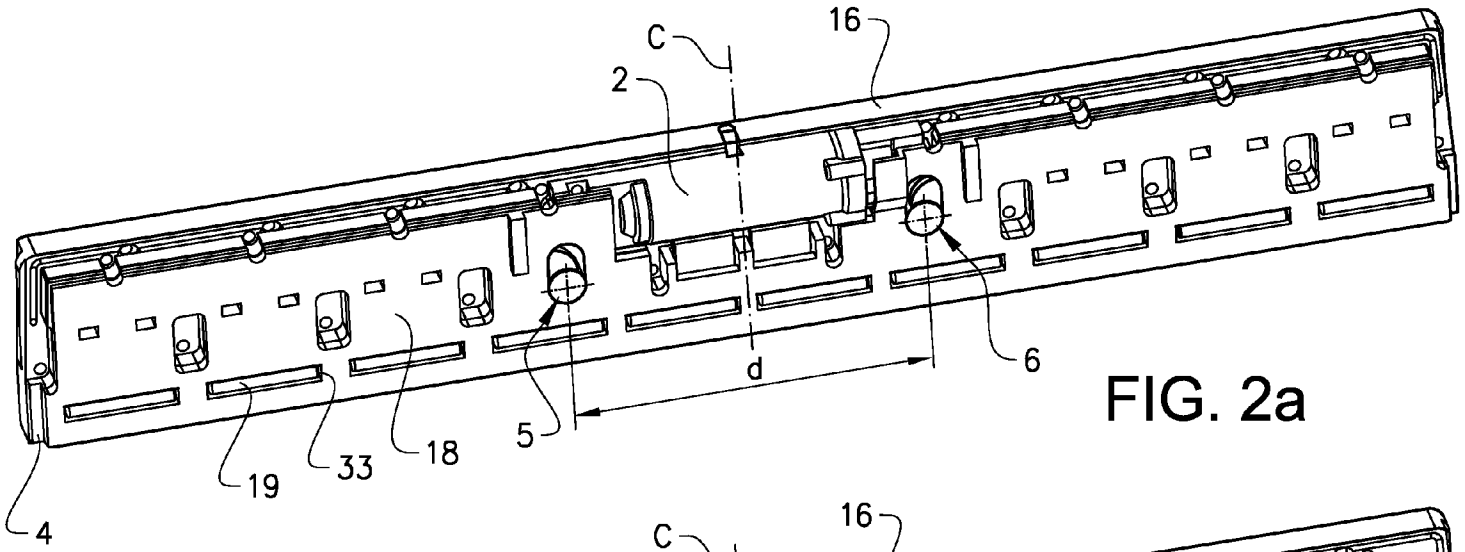
FIG. 2*a, b* illustrate a retracted and a extracted position of the device.
Figure 2B:
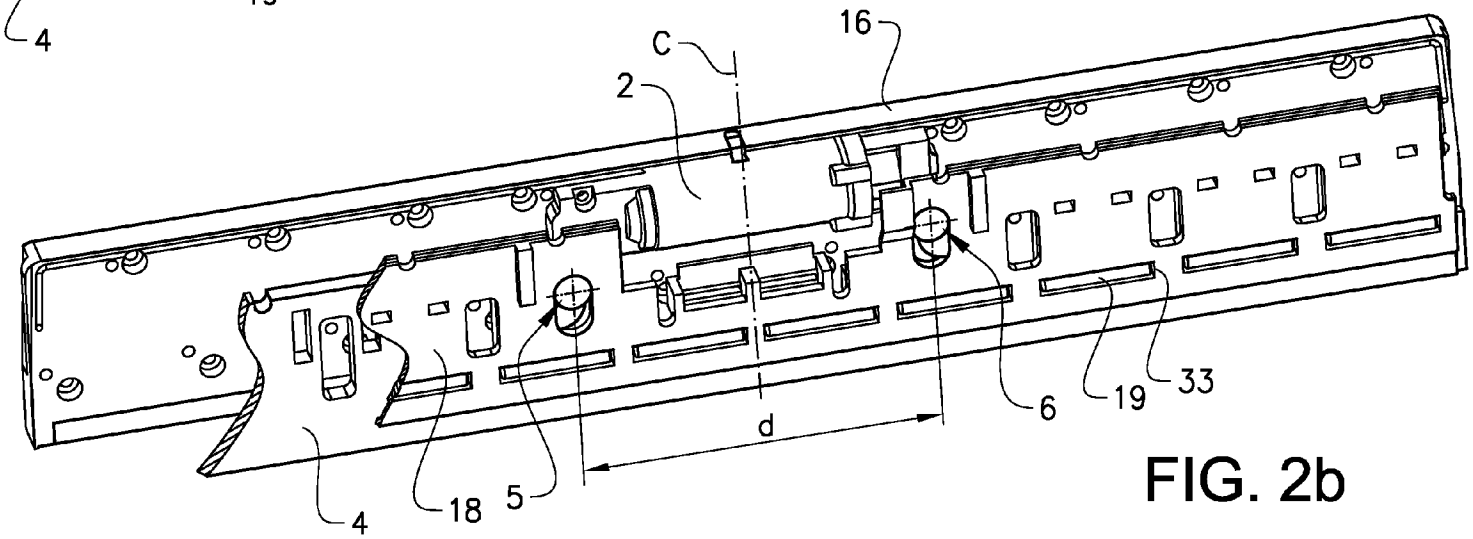

FIG. 2*a* illustrates the device 1 having the interceptor member 4 in a retracted position and FIG. 2*b* illustrates the device 1 having the interceptor member 4 in an extracted position. The front plate 17 is removed from FIGS. 2*a* and *b* in order to expose the interior of the device 1. In FIG. 2*b* is a part of the interceptor member 4 and the holding member 18 cut out.

Figure 3A:
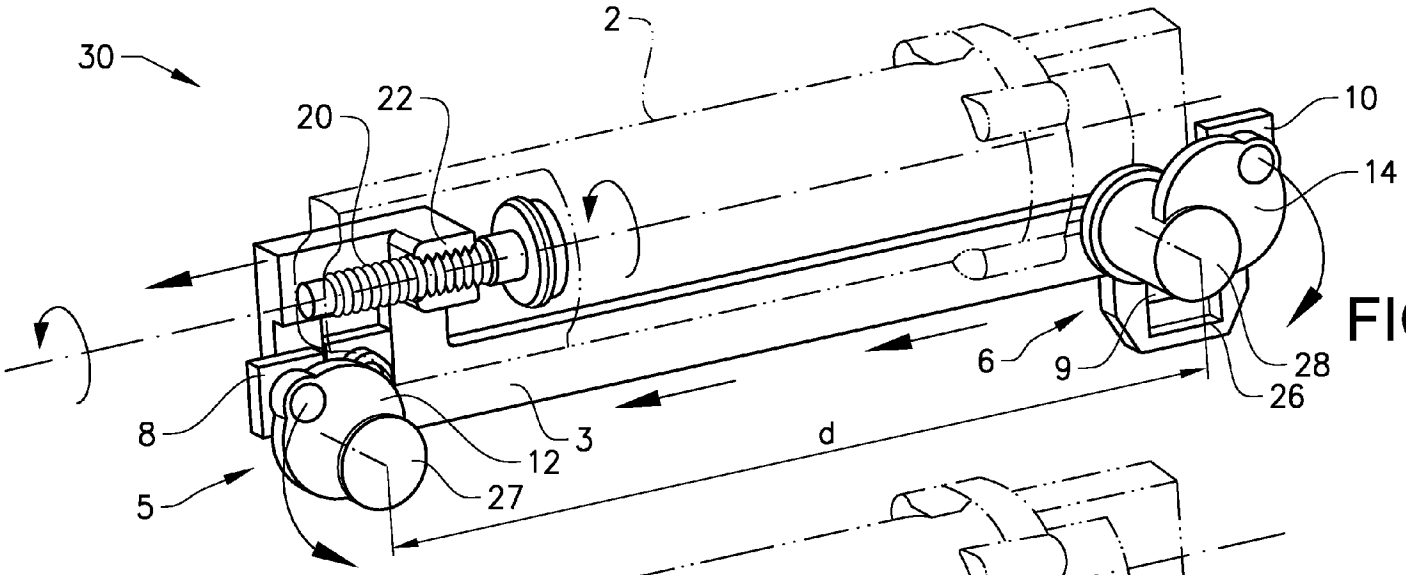
FIG. 3*a, b* illustrate the transmission means from a first view corresponding to a retracted (3*a*) and an extracted (3*b*) position of the device.
Figure 3B:
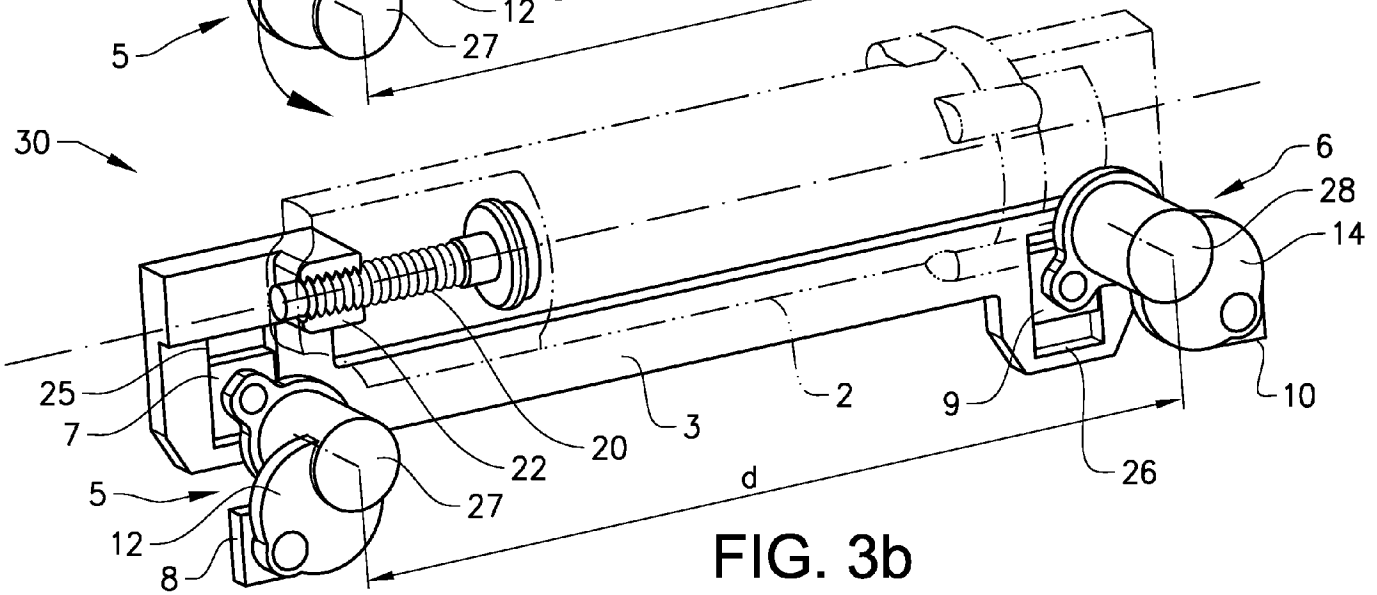
Figure 4A:
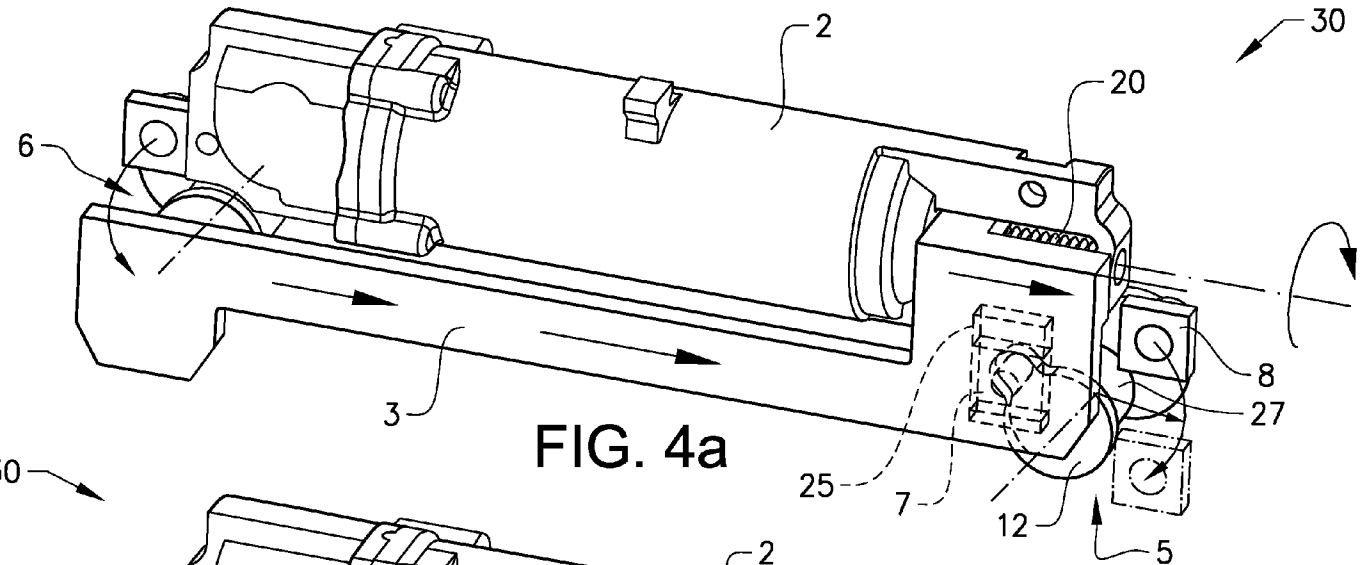
FIG. 4*a, b* illustrate the transmission means from a second view corresponding to a retracted (4*a*) and an extracted (4*b*) position of the device.
Figure 4B:
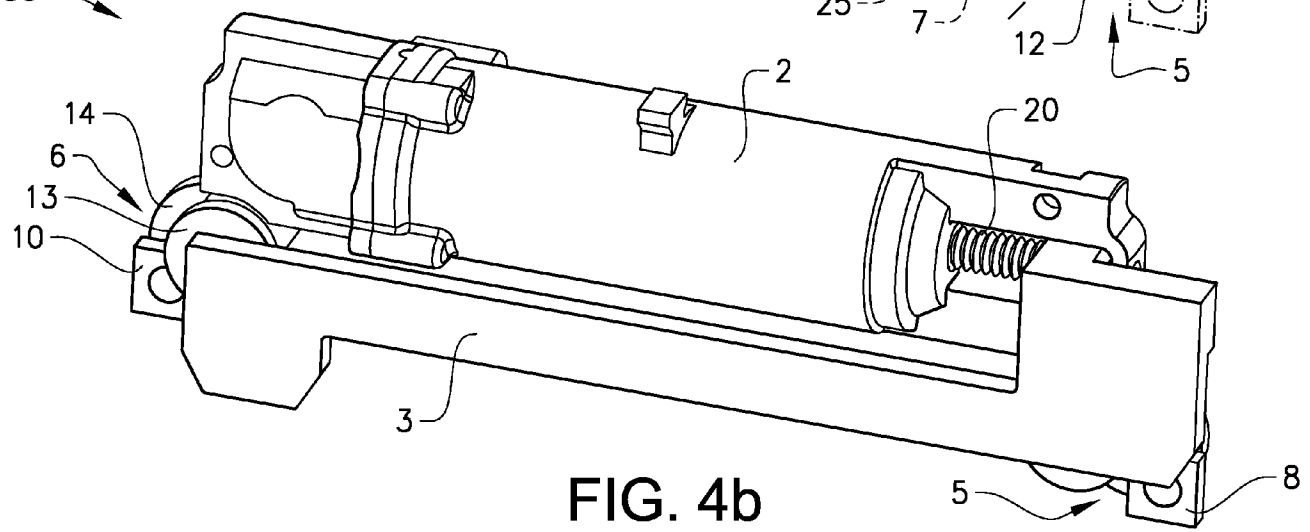

FIGS. 3*a* and *b* illustrate the transmission means 30 of the device 1 in a position corresponding to the retracted position of the device shown in FIG. 2*a*. The actuator 2 is just marked with outlines in FIGS. 3*a* and *b* in order to show otherwise thereby hidden features. FIGS. 4*a* and *b* illustrate the transmission means 30 of the device 1 in a position corresponding to the extracted position of the device shown in FIG. 2*b*.

Figure 5A:
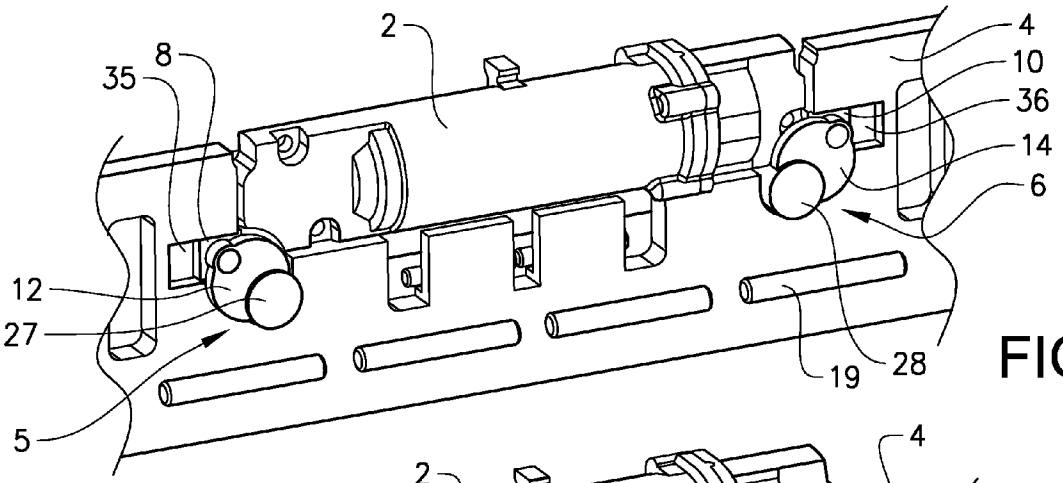
FIG. 5*a, b* illustrate the displacement of the interceptor member.
Figure 5B:
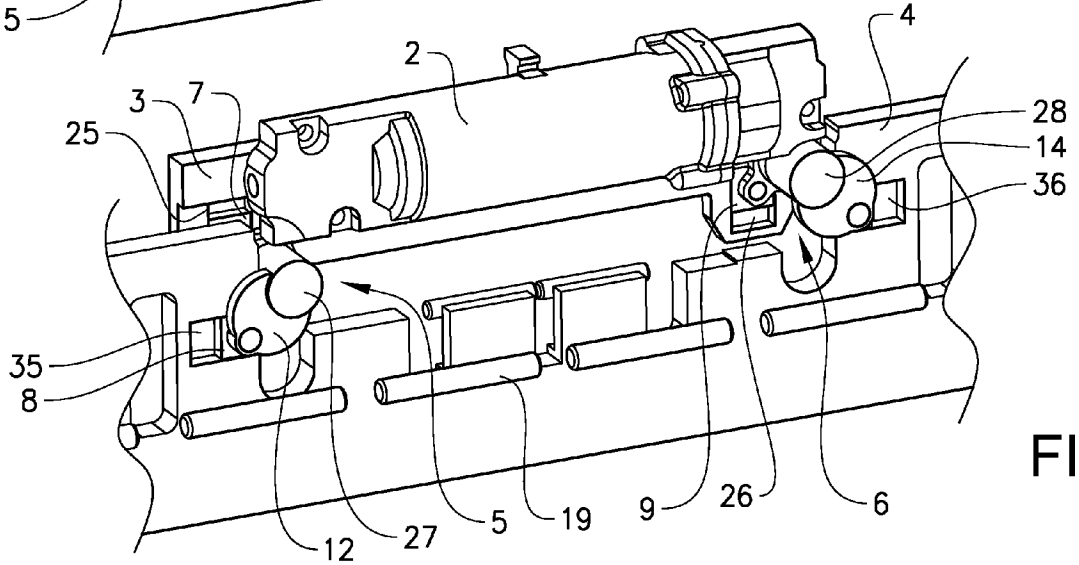

FIG. 5*a* discloses a cut out of the interceptor member 4 in a retracted position, and FIG. 5*b* discloses the same cut out of the interceptor member 4 in a extracted position.

Now the function of the device 1 will be described in conjunction with the FIGS. 2-5. As described above, the actuator 2 is operably connected with the actuating means 3. Further, the actuator 2 comprises a shaft portion that is designed as a lead screw 20. The lead screw 20 has a continuous thread 21 and the actuating means 3 has a complimentary threaded section 22 which facilitates the connection of the actuating means 3 to the actuator 2.

Further, the first crankshaft 5 and the second crankshaft 6 are connected with the actuating means 3 by a first preformed groove 25 and a second preformed groove 26, respectively, which are provided in the actuating means 3. The first preformed groove 25 is adapted to receive the first sliding shoe 7 of the first crankshaft 5 and the second preformed groove 26 is adapted to receive the first sliding shoe 10 of the second crankshaft 6. The first and the second groove 25, 26 in the actuating means 3 are arranged such that the first sliding shoes 7, 10 can slide in opposite directions relative each other and perpendicular to the movement of the actuating means 3.

Further, a first and a second groove 35, 36 are provided on the interceptor member 4, said first and second groove 35, 36 in the interceptor member 4 are adapted to receive the second sliding shoes 8, 9. The grooves 35, 36 in the interceptor member 4 are shown in FIG. 1*c*, and are arranged perpendicular to the first and second groove 25, 26 in the actuating means 3, such that the second sliding shoes 8, 9 can slide therein.

With the above described arrangement of the sliding shoes 7, 8, 9, 10 in their corresponding grooves 25, 26, 35, 36 the swinging motion of the cranks 11, 12, 13, 14 can be compensated, in that that they slide in the grooves 25, 26, 35, 36.

In operation, whenever the actuator 2 acts upon the actuating means 3, the actuating means 3 moves in a first direction that is parallel to the length direction of the device 1. This movement is realised using the lead screw 20, which is as described above. Further, the actuating means 3 which is operable connected with the interceptor member 4 displaces the interceptor member 4 in a second direction which is perpendicular to the first direction of displacement of the actuating means 3.

As described above, the first crankshaft 5 and the said second crankshaft 6 are operably connected to the actuating means 3. This arrangement is made in such a manner that the first crankshaft 5 and the second crankshaft 6 acts on different heights upon the actuating means 3. However, the second cranks 12, 14 of respective crankshaft 5, 6 act upon the interceptor member 4 on essentially the same height h (shown in FIG. 1*c*), i.e. same distance from the lower edge of the interceptor member 4.

Essentially the same height is defined such that the lowest part of the highest positioned sliding shoe never is above the highest part of the lowest positioned sliding shoe. For the side force cancellation it is optimal that the first and second cam shaft interacts with the interceptor member on exactly the same height. However, essentially (as defined above) the same height is enough to achieve the desired effect to avoid using guiding means.

Further, whenever the actuating means 3 is displaced the movement causes the first crankshaft 5 and the second crankshaft 6 to rotate in an opposite direction relative to each other. As the pair of first sliding shoes 7, 9, slide in the preformed grooves 25, 26, the crankshafts 5, 6 rotate in opposite directions relative to each other, whereby, the second sliding shoes 8, 10 of the first and second crankshafts 5, 6 slide in their respective groove 35, 36 (shown in FIG. 1*c*) in the interceptor member 4 and act thereupon, such that the interceptor member 4 is displaced.

The second cranks 12, 14 interact additionally upon the holding member 18, such that the holding member 18 is displaced half the distance of the interceptor member 4 during a retraction or extraction of the interceptor member 4. Corresponding grooves therefore are provided in the holding member 18.

Further, whenever it is desirable to retract the interceptor member 4, the actuator 2 can be operated in a reverse direction.

The device 1 of the present invention is primarily used for controlling the running trim and/or steering of a boat. As mentioned above, the device 1 is operated suitably to gain the desired effect of trim control of the boat. Further, the device 1 is used to control the steering of the boat to change the heading of the boat and/or heeling when turning.

Moreover, the device 1 is adapted to be used with a mono hull boat or with a boat with multiple hulls. The device 1 can be connected to and controlled from a control system of any previously known type. For example, the control system can be a PLC/computer based system present on board a boat or vessel.

Reference signs mentioned in the claims should not be seen as limiting the extent of the matter protected by the claims, and their sole function is to make claims easier to understand.

As will be realised, the invention is capable of modification in various obvious respects, all without departing from the scope of the appended claims. Accordingly, the drawings and the description thereto are to be regarded as illustrative in nature, and not restrictive.

When the invention is utilised primarily for dynamic control of longitudinal running trim of a boat, one single device according to the invention or several cooperating devices according to the invention can be used. In this case the device or the cooperating devices is/are activated to the degree necessary in order to achieve the desired running trim of the boat, e.g. in order to avoid the bow of the running boat rises to high.

When the invention instead is utilised primarily for dynamic control of transversal trim i.e. list of a boat, a pair of devices according to the invention are suitably used. Thereby, one of the devices according to the invention is attached close to the starboard end of the stern, while the other device is attached close to the port end of the stern. In this case, the pair of devices according to the invention is activated in an individual manner, i.e. the device at the end of the stern of the running boat which is closer to the water surface is activated to a higher degree than the device attached to the opposite end of the stern. However, embodiments of the invention are also conceivable with more than two devices according to the invention utilised for the above-described control strategy.

If the two above described strategies are combined, dynamic control of both running trim and list of a running boat can be achieved by means of the invention.

What is claimed is:

1. Device for controlling at least one of trim and steering of a boat, ship or vessel, said device comprising;

an actuator;

actuating means; and an interceptor member;

wherein said actuator is adapted to interact with said actuating means, which is adapted to interact with said interceptor member, such that said interceptor member is linearly displaceable between a retracted and an extracted position, said actuating means is adapted to interact with a first and a second crankshaft, which thereby rotate, wherein said first and second crankshaft are arranged relative to each other such that said crankshafts rotate in opposite directions when said actuating means interacts therewith, and whereby said crankshafts interact with said interceptor member such that a rotation of said crankshafts consequently lead to a displacement of said interceptor member between said retracted and said extracted position.

2. Device according to claim 1, wherein said crankshafts are arranged at a distance to each other in the length direction of the interceptor member and said crankshafts interact with said interceptor member essentially on the same height of the interceptor member.

3. Device according to claim 1, wherein said crankshafts are arranged essentially symmetrically about a centerline of said interceptor member.

4. Device according to claim 1, wherein said actuating means is displaceable in a direction perpendicular to the direction of the displacement of said interceptor member.

5. Device according to claim 1, wherein said crankshafts are each provided with a central shaft with a first and a second crank in each end of said central shaft, wherein said first cranks interact with said actuating means and said second cranks interact with said interceptor member, wherein said first cranks are displaced relative to said second cranks.

6. Device according to claim 5, wherein said first cranks are displaced with about a quarter of a revolution relative to said second cranks.

7. Device according to claim 5, wherein said first cranks are each provided with a first sliding shoe, wherein said first sliding shoes are adapted to slide in corresponding grooves in said actuating means.

8. Device according to claim 5, wherein said second cranks are each provided with a second sliding shoe, and said second sliding shoes are adapted to slide in corresponding grooves in said interceptor member.

9. Device according to claim 1, wherein said device is provided with a back plate and a front plate and wherein said actuating means, crankshafts and interceptor member are arranged in-between said back and front plate.

10. Device according to claim 9, wherein said back plate is provided with a lip which extends perpendicular to the displacement of said interceptor member and said lip is adapted to seal between said back plate and said interceptor member.

11. Device according to claim 9, wherein said actuator is mounted in-between said back and front plate.

12. Device according to claim 5, wherein a roller holding member is mounted on said interceptor member, wherein said second cranks are adapted to act upon said roller holding member such that said roller holding member is displaced half the distance of said interceptor member.

13. Device according to claim 1, wherein said actuator is an electric actuator.

14. Boat, ship or vessel provided with a device according to claim 1.

* * * * *